US007230542B2

(12) United States Patent
Smits et al.

(10) Patent No.: US 7,230,542 B2
(45) Date of Patent: Jun. 12, 2007

(54) STREAMLINING DATA TRANSFER TO/FROM LOGGING WHILE DRILLING TOOLS

(75) Inventors: Jan Wouter Smits, Sugar Land, TX (US); Anthony Collins, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 319 days.

(21) Appl. No.: 10/154,265

(22) Filed: May 23, 2002

(65) Prior Publication Data

US 2003/0218547 A1 Nov. 27, 2003

(51) Int. Cl.
*G01V 3/00* (2006.01)

(52) U.S. Cl. ..... 340/853.9; 711/115

(58) Field of Classification Search ..... 340/853.9, 340/853.3, 853.1, 854.8, 853.4, 854.4; 702/187; 711/115

See application file for complete search history.

(56) References Cited

U.S. PATENT DOCUMENTS

| | | | | |
|---|---|---|---|---|
| 3,939,705 | A | 2/1976 | Glotin et al. | |
| 4,216,536 | A * | 8/1980 | More | 367/83 |
| 4,736,204 | A | 4/1988 | Davison | |
| 4,806,153 | A | 2/1989 | Sakai et al. | |
| 4,806,928 | A | 2/1989 | Veneruso | |
| 4,901,069 | A | 2/1990 | Veneruso | |
| 4,928,088 | A | 5/1990 | Jorion et al. | |
| 5,083,124 | A * | 1/1992 | Nordstrom | 340/853.1 |
| 5,130,705 | A | 7/1992 | Allen et al. | |
| 5,160,925 | A * | 11/1992 | Dailey et al. | 340/853.3 |
| 5,455,573 | A | 10/1995 | Delatorre | |
| 5,899,958 | A | 5/1999 | Dowell et al. | |
| 5,955,666 | A * | 9/1999 | Mullins | 73/152.18 |
| 6,064,210 | A | 5/2000 | Sinclair | |
| 6,158,276 | A * | 12/2000 | Patey et al. | 73/152.18 |
| 6,343,649 | B1 | 2/2002 | Beck et al. | |
| 6,831,571 | B2 * | 12/2004 | Bartel | 340/854.6 |
| 2001/0029780 | A1 | 10/2001 | Bartel | |
| 2005/0145416 | A1 * | 7/2005 | Reed et al. | 175/40 |

FOREIGN PATENT DOCUMENTS

| | | | |
|---|---|---|---|
| GB | 2358206 | A | 7/2001 |
| WO | WO 01/42622 | A1 | 6/2001 |

* cited by examiner

*Primary Examiner*—Timothy Edwards, Jr.
(74) *Attorney, Agent, or Firm*—Kevin P. McEnaney; Brigitte L. Echols; Dale V. Gaudier

(57) ABSTRACT

The invention provides a more efficient way to transfer data to or from a logging tool during a drilling process. A memory module is provided for rapid insertion and retrieval from a logging while drilling tool between drilling runs. The memory module records and stores data collected during the drilling process. A process of the invention includes removing the memory module from the tool; loading a new memory module into the tool that contains the desired tool parameters for the next run. The retrieved memory module is then connected to an independent surface system to download the stored data.

22 Claims, 4 Drawing Sheets

STREAMLINING DATA TRANSFER TO/FROM LOGGING WHILE DRILLING TOOLS

BACKGROUND OF THE INVENTION

1. Field of the Invention

This invention relates generally to the field of well logging. More particularly, the invention relates to the transfer and retrieval of data to and from a downhole tool used to measure subsurface properties.

2. Background Art

Modern petroleum drilling and production operations demand a great quantity of information related to subsurface properties and conditions. Such information includes characteristics of the formations traversed by the well bore, in addition to data relating to the size and configuration of the actual well bore. The collection of information relating to these subsurface properties is commonly referred to as "well logging." Well logging operations are performed by several methods.

In "wireline" well logging, measurements are taken in a well bore (with the drill string removed) by lowering a logging instrument or tool into the well bore on an armored wireline cable and taking measurements with the suspended tool. Data is transferred between the suspended tool and the surface via the wireline cable.

Although wireline techniques have been the primary means for performing well logging for many years, the current trend is to perform the downhole measurements during the actual drilling of the well bore. This technique is referred to as "Logging-While-Drilling" or "Measurement-While-Drilling" [These terms are interchangeable and are referred to herein as (LWD)]. One of the primary reasons for this trend is the limitations associated with wireline logging. By collecting data during the drilling process, without the necessity of removing the drilling assembly to insert a wireline tool, subsurface data can be collected sooner and more economically.

The aim of LWD operations is to make downhole measurements of petrophysical, geological, mechanical and other parameters during the drilling process. The measurements are made using instruments disposed in the Bottom-Hole Assembly (BHA) of the drilling string. A part of the measured data is typically transmitted to the earth surface using a conventional telemetry system. However, due to bandwidth limitations in typical telemetry systems, only limited amounts of data can be transmitted between the surface and the tool during the actual drilling operation. In order to preserve much of the data collected during the drilling operation, a great deal of the data is stored in the tool until the instrument is brought back to the surface. Although this process may not be ideal, given the relatively slow data rates achievable in communications between downhole instruments and surface equipment, storing the collected data may be the only option for the majority of data.

With conventional data retrieval techniques, the stored data is retrieved from the tool memory when the tool is brought to the surface. At the same time, new parameter configuration data is often programmed into the tool memory to change the tool's mode of operation on the next drilling run. With conventional LWD tools, this operation of retrieving the data (or "Dumping" the memory) can cause significant disruption of the drilling process. Delay or disruption occurs because the rig has to remain inactive while the information in the memory is downloaded into the surface processing equipment. This process is especially expensive in offshore operations, which results in substantial economic loss.

In conventional tools, the downhole memory is typically downloaded to surface data processing equipment through a "Read-Out-Port" (ROP) on the side of the tool. This ROP typically comprises a connector internal to the tool and a hole in the collar through which the connector can be attached to the data processing equipment. A cable is used to connect surface equipment to the tool through the ROP. The hole in the collar is typically sealed with a pressure-tight insert before the tool is lowered into the well. One drawback of this system is that the tool has to remain immobile during the time needed to download the memory and reconfigure the tool. Increased data volume increases typical download times long enough to significantly impact the rig operations. Another drawback is the cable, which is a weak link in the system in terms of reliability and poses a safety hazard (tripping) to personnel.

U.S. Pat. No. 6,343,649 describes a technique for communicating with a downhole tool by conveying a service tool into the tubular string for engagement with a downhole communication device. U.S. Pat. No. 5,130,705 describes a self-contained data recorder for monitoring and collecting fluid dynamics data in a well pipe. U.S. Pat. No. 4,806,153 describes a technique for storing information about soil conditions using a cableless unit that includes a memory storage device adapted to collect the information throughout the drilling operation. After completion of the drilling process, the memory storage device is connected to a data processing unit to extract the collected information. U.S. Pat. No. 4,736,204 proposes using electromagnetic signals as a means for transmitting the stored data to a receiver mounted to the exterior of a logging tool. U.S. Pat. No. 4,928,088 (assigned to the present assignee) describes a technique using an electromagnetic link through an aperture in the side of a logging tool to establish a communications link between internal and external electronic systems.

GB 2358206 describes an LWD system that incorporates a stand-alone data download device. In this system, the data download device electrically couples to the tool and downloads data stored in the memory of the tool to a memory within the data download device. After the information is exchanged, the data download device can be de-coupled from the tool and physically carried to a location near the surface computer where logging information, now contained in the memory of the data download device, can be read by the surface computer.

These techniques continue to impose a delay to the drilling process while the data is manipulated and transferred. Thus there remains a need for a way to transfer data to and from a downhole tool, particularly during a drilling operation, in an efficient and expedient manner.

SUMMARY OF THE INVENTION

The invention provides a system for transferring data to or from a logging tool adapted for drilling operations within a subsurface formation. The system comprises a logging tool adapted to make measurements of subsurface properties while drilling through the subsurface formation; a memory module housed within the tool, the module adapted to record and store data including data related to the measurements; the memory module adapted for extraction from the tool; and the memory module adapted for coupling to a data processor adapted to receive the stored data.

The invention provides a method for transferring data to or from a logging tool adapted for drilling operations within a subsurface formation. The method comprises housing a memory module within the tool, the module adapted to record and store data; measuring a subsurface property using the logging tool; recording and storing data related to the measurements in the memory module; retrieving the memory module from the tool; and downloading the stored data contained in the memory module to data processing equipment.

The invention provides a memory module for a logging tool adapted for drilling operations within a subsurface formation. The module comprises a modular memory body having an inner end and an outer end; the modular memory body adapted to record and store data; non-volatile memory means housed within the modular memory body; and coupling means at the inner end of the modular memory body to establish communication between the modular memory and electronic circuitry inside the tool.

BRIEF DESCRIPTION OF THE DRAWINGS

Other aspects and advantages of the invention will become apparent upon reading the following detailed description and upon reference to the drawings in which.

DETAILED DESCRIPTION OF SPECIFIC EMBODIMENTS

The invention comprises a modular memory that can easily be inserted and extracted from a logging tool. The modularity of the memory enables the memory to be inserted as well as detached and retrieved from the logging tool during the drilling process. Because the memory is a detachable module, another modular memory can be inserted into the logging tool in one step during the same drilling process. After insertion of a replacement module, the drilling and logging process continues without the, need to wait for the completion of a memory download process. The contents of the retrieved memory module can then be downloaded (locally or remotely) into data processing equipment while the drilling and logging process continues downhole.

Figure 1:
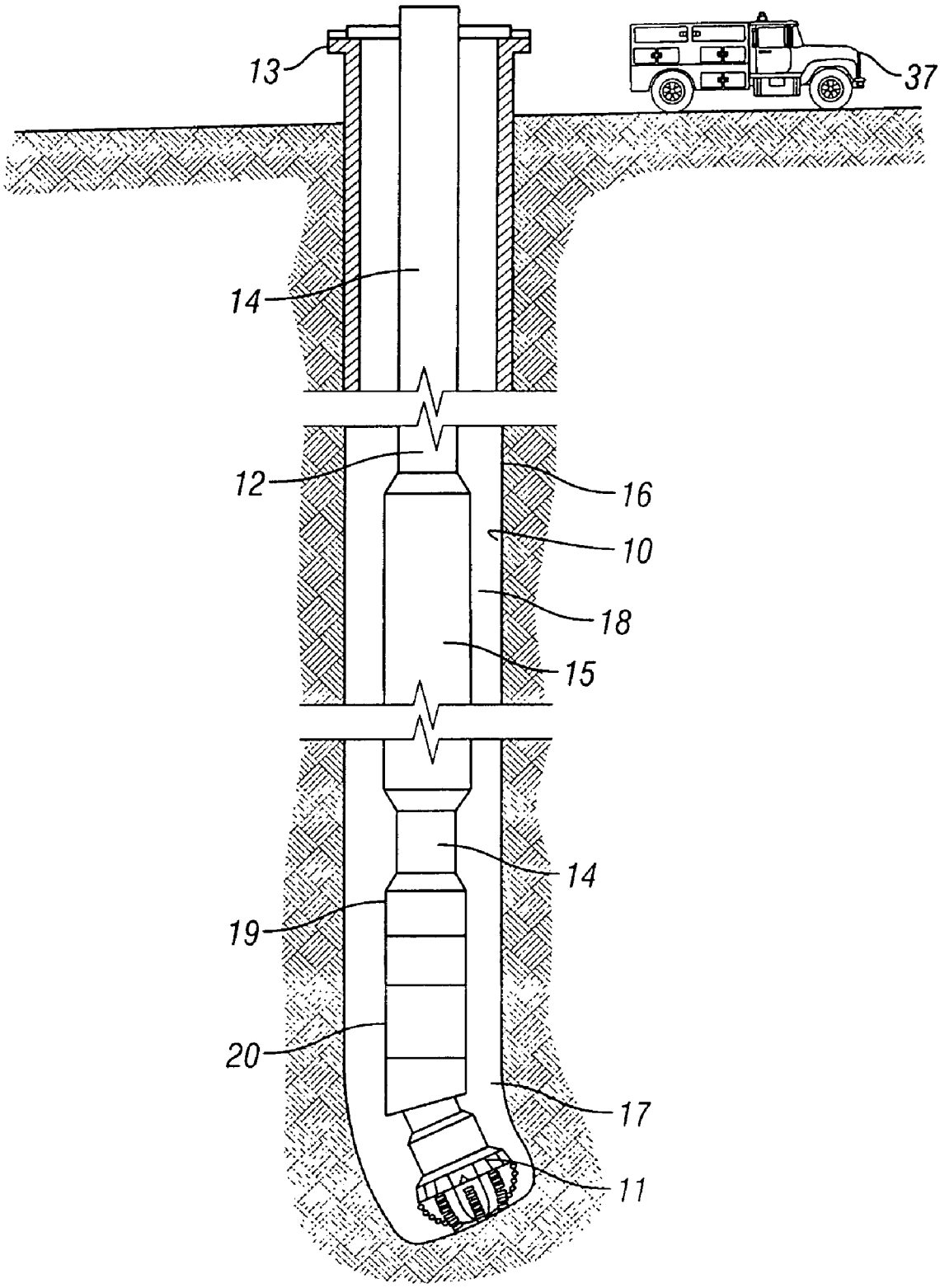
FIG. 1 is a schematic diagram of a typical well drilling assembly.

FIG. 1 shows a bottom hole drilling assembly in a well bore. The well bore 10 is being drilled by a bit 11 attached to the lower end of a drill string 12 that extends upward to the surface where it is coupled to the rotary table 13 of a typical drilling rig (not shown). The drill string 12 usually includes drill pipe 14 that suspends a length of heavy drill collars 15 terminating with the drill bit 11. The well bore 10 is shown as having a vertical or substantially vertical upper portion 16 and a curved lower portion 17 which is drilled under the control of a drilling tool 20. Surface pumps circulate drilling fluid, or "mud", down through the drill string 12 where it exits through jets in the bit 11 and returns to the surface through the annulus 18 between the drill string 12 and the walls of the well bore 10 (not shown). The mudflow also passes through a turbine, which drives a generator that supplies electrical power to the system as known in the art.

A LWD tool 19 is connected in the drill string 12 between the upper end of the drilling tool 20 and the lower end of the pipe section 14. The LWD assembly is usually housed in a nonmagnetic drill collar, and includes directional sensors such as orthogonally mounted accelerometers and magnetometers which respectively measure components of the earth's gravity and magnetic fields and produce output signals which are fed to a memory connected to a controller (not shown). The present invention may be implemented with conventional LWD tools 19 equipped with such sensors, as well as others adapted to make other measurements (e.g. acoustic, gamma ray, EM energy, or pressure sensors).

Figure 2:
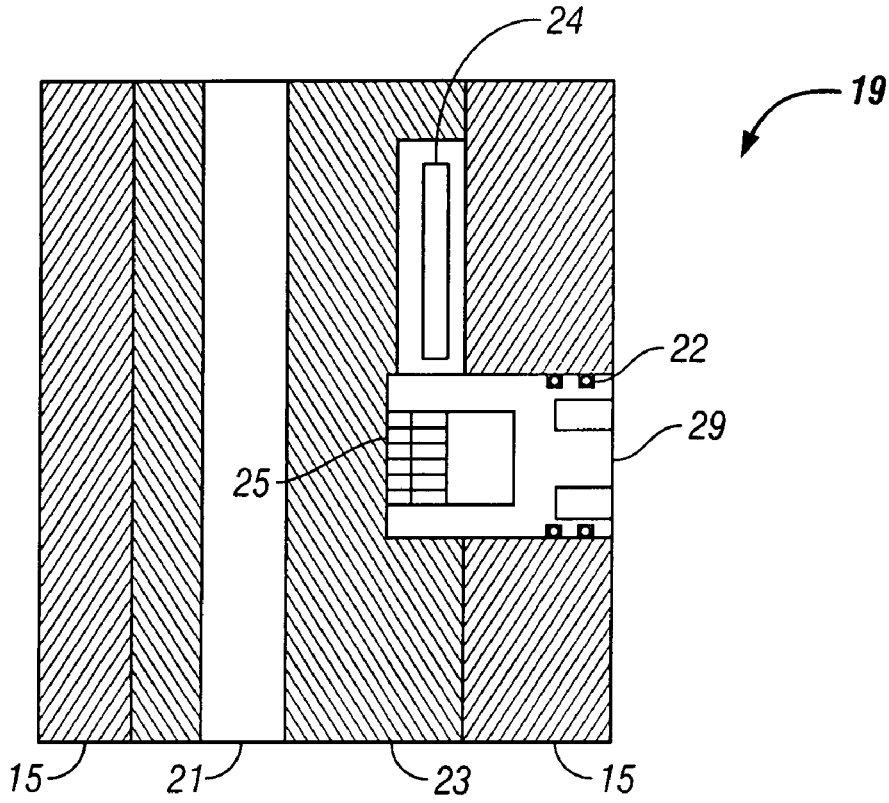
FIG. 2 is a schematic diagram of a memory module embodiment as implemented in a logging tool in accord with the invention.

FIG. 2 shows a section of the drilling tool 19 containing an embodiment of the memory module 29 of the invention. The tool contains an electronic chassis 23 within the collar 15 of the tool 19. The chassis 23 houses the circuitry to control tool and measurement operations as known in the art. The chassis 23 also houses circuitry 24 to provide an interface between the memory module 29 and the measurement circuitry. An internal passage 21 through the chassis 23 allows for flow of drilling mud through the tool to the drill bit 11. The collar 15 has an aperture 22 extending into the chassis 23 and leading to a connector 25 for communication between the memory module 29 and the processing circuitry. The drill collar 15 may also be equipped with a cover or plug to seal the aperture 22 opening during drilling operations (not shown).

Figure 3:
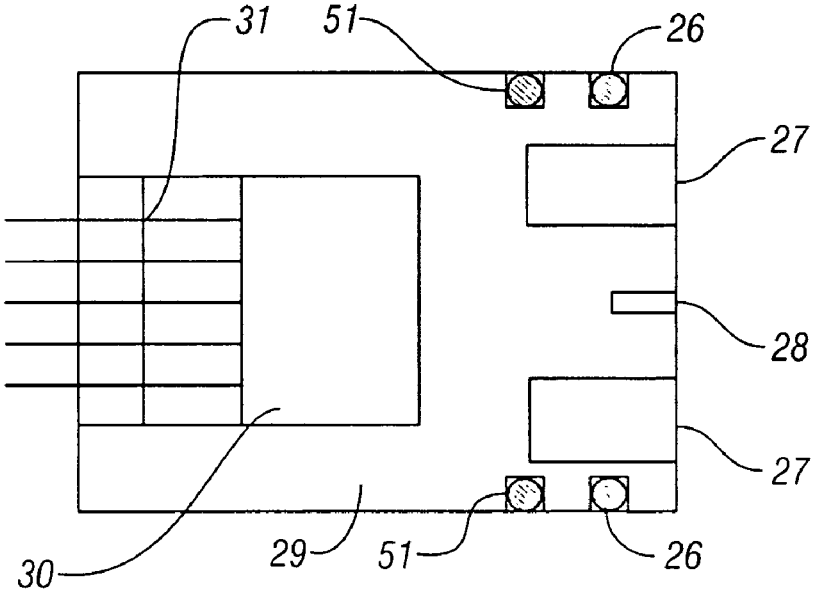
FIG. 3 is a schematic diagram of a data storage device in accord with the invention.

FIG. 3 shows a modular memory embodiment of the invention. The module 29 is adapted for insertion into the tool 19. The memory has the capability of recording the data obtained by the tool sensor(s). The memory module 29 is preferably cylindrical in form for easy insertion and extraction from the aperture 22. O-rings 26 are disposed in grooves 51 on the exterior of the module 29 to seal the module within the collar 15. When deployed downhole, the collar and module are typically exposed to high pressures and temperatures. According to this embodiment, the module body has grooves 27 formed at the outer end. The grooves 27 allow for expansion, which improves the seal by activating the O-rings 26. A retaining ring may also be used to retain the module within the collar if desired (not shown). The module 29 is also implemented with a threaded hole 28 in the center of the outer surface to allow for easy extraction from the collar 29.

The module 29 also comprises electronic memory circuitry 30. Any suitable memory, whether known or subsequently developed, may be used to implement the module 29. For example, one embodiment uses non-volatile memory consisting of Flash or E2PROM devices with a capacity of one or two Gigabytes. Depending on the amount of memory needed and the size of the module 29, different packaging techniques may be used, such as, but not limited to:

1. Plastic Encapsulated Surface Mount Components mounted on rigid or flexible Printed Circuit Boards.
2. Chip On Board technique, in which bare chips are mounted directly on a PCB.

3. Multi-Chip Module techniques, in which bare chips are combined on a single substrate and encapsulated in ceramic or epoxy compounds. Modern techniques allow stacking the chips vertically to achieve maximum packaging density.

According to this embodiment, both the memory circuitry 30 and the electronic chassis 23 have electrical connectors 31, 25 that couple together when the module 29 is inserted in the tool to allow for power and read/write signal communication between the tool interface circuitry and the memory circuits. The module 29 may also be equipped with its own power source (e.g. battery) if needed.

Figure 4:
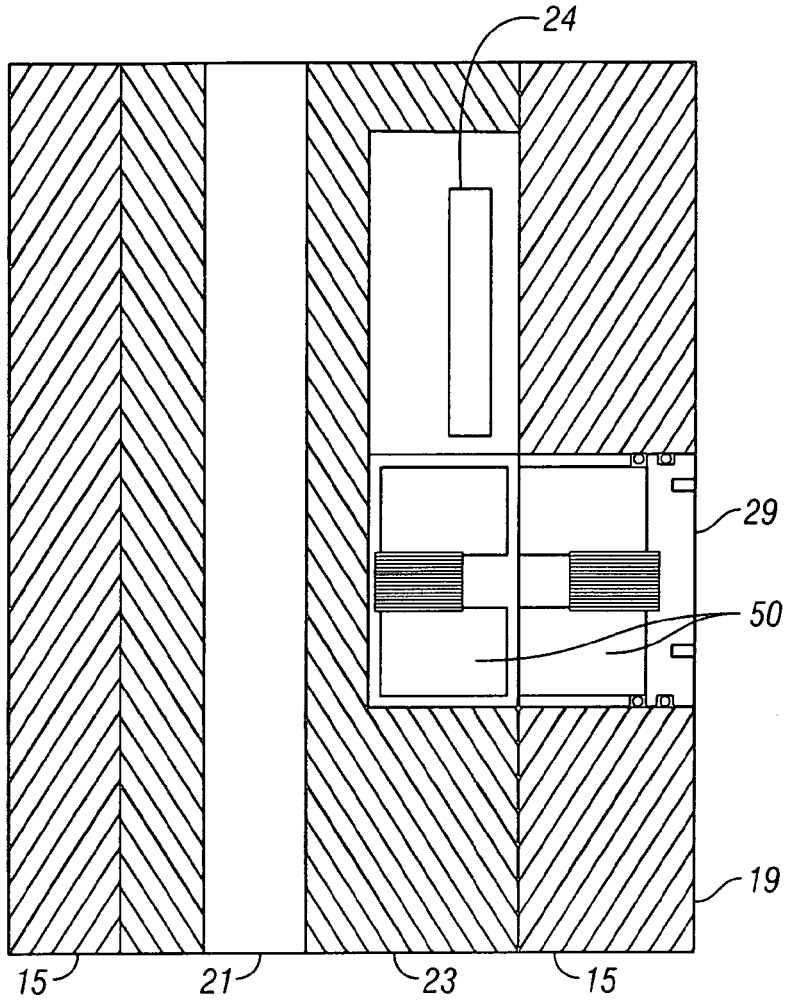
FIG. 4 is a schematic diagram of another memory module embodiment as implemented in a logging tool in accord with the invention.

FIG. 4 shows another memory module 29 embodiment of the invention. According to this embodiment, the module is coupled to the tool interface circuitry via inductive couplers 50. The couplers 50 consist of windings formed around a ferrite body. The module's electronic memory and connection to the circuitry 24 are not shown for clarity of illustration. As shown in FIG. 4, the inductive couplers 50 have "U" shaped ferrite cores. The ferrite core and windings may be potted in fiberglass-epoxy and over molded with rubber as known in the art. The circuit model for inductive coupling is well known in the art. For example, U.S. Pat. Nos. 4,928,088, 4,901,069, 4,806,928 (all assigned to the present assignee) and U.S. Pat. No. 5,455,573, illustrate circuit models that may be used to implement inductive coupling according to the invention.

In operation, there will be a gap between the inductive couplers 50 in the chassis 23 and the module 29, so the coupling will not be 100% efficient. To improve the coupling efficiency, and to lessen the effects of mis-alignment of the pole faces, it is desirable for the pole faces to have as large a surface area as possible. It will be appreciated by those skilled in the art that other aperture configurations and mounting techniques may be implemented to achieve the desired coupling.

Figure 5:
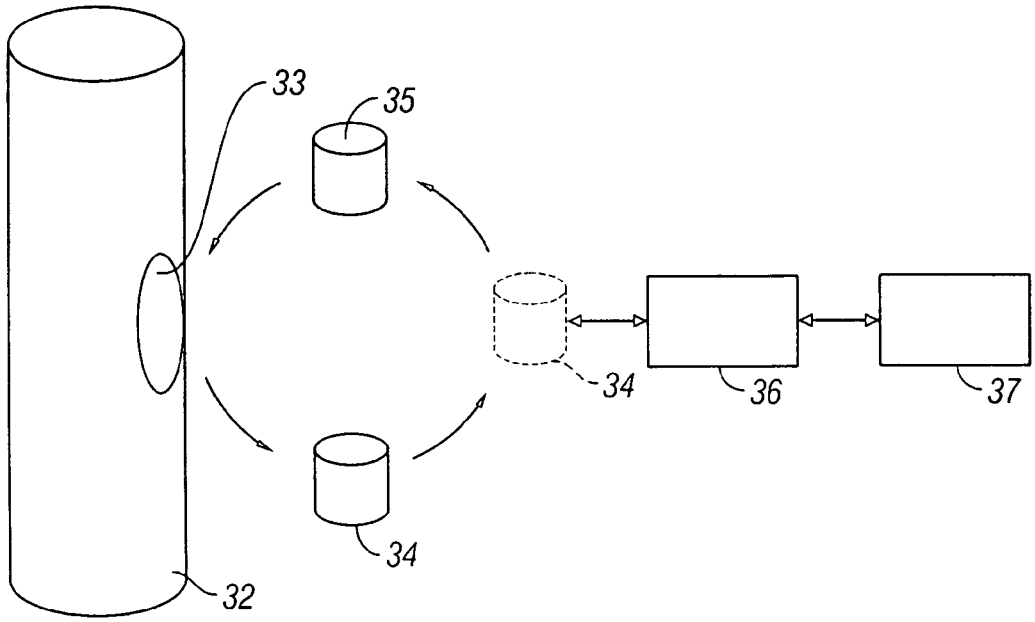
FIG. 5 is an illustration of a system for transferring recorded data and reconfiguring a logging tool in accord with the invention.

FIG. 5 illustrates a system for transferring data and reconfiguring the tool according to the invention. The logging tool 32 has an aperture 33 on its side. The system contains multiple memory modules 34, 35 of the invention. An interface 36 is used to connect the memory module containing stored data to a data processing device 37. The processing device 37 is a suitable general-purpose computer having appropriate hardware. The precise forms of the interface and processing device are immaterial here.

In one embodiment of the invention, a clean memory module 34 is inserted into the aperture 33. The module is inserted within the aperture and coupled to the electronic interface via the electrical connectors 31, 25 or the inductive couplers 50. At this point, the drilling process is initiated. After a certain period of drilling and recording, the tool 32 is retrieved to the surface. The memory module 34 is then extracted from the tool through the aperture 33 and the stored data is retrieved.

Following the removal of the modular memory 34, a new memory module 35 is loaded into the tool to replace the original or previous memory module. This newly loaded module may contain parameters and other data related to the tool configuration for the next drilling run. At this point, the tool 32 is re-inserted into the well bore and the drilling and logging process continues. The retrieved memory module 34 can be hand-carried to the surface system to download the stored data. The interface 36 connects the memory module to the data processing equipment 37 for the downloading operation. As discussed above, in this procedure, the actual step of downloading the memory has been de-coupled from the drilling operations.

Figure 6:
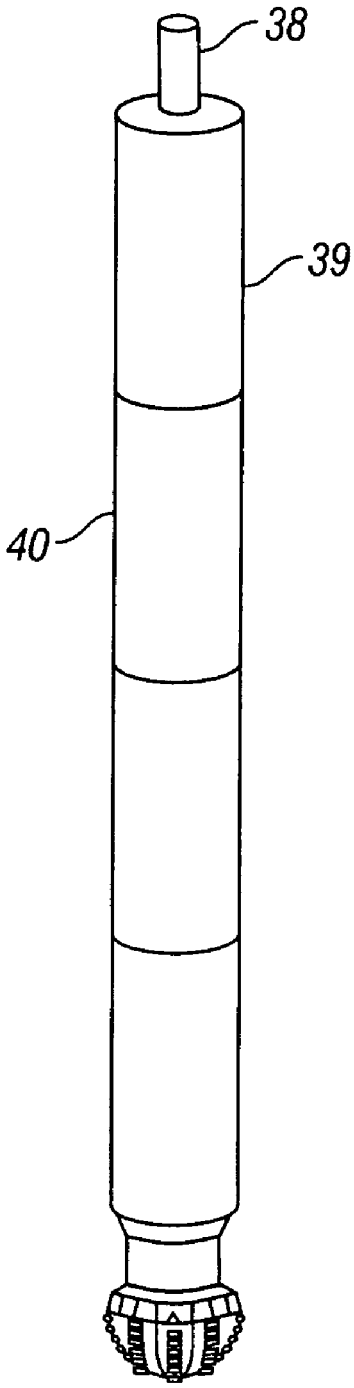
FIG. 6 is a schematic diagram of a logging system utilizing a memory module in accord with the invention.

FIG. 6 shows another embodiment of the invention in which the memory module 38 is positioned in the upper portion 39 of the BHA 40. According to this embodiment, the memory module 38 is inserted and retrieved from the end of the tool. The memory module may be disposed at either end of the tool. The module 38 plugs into the chassis inside the collar in a similar manner as described above.

Figure 7:
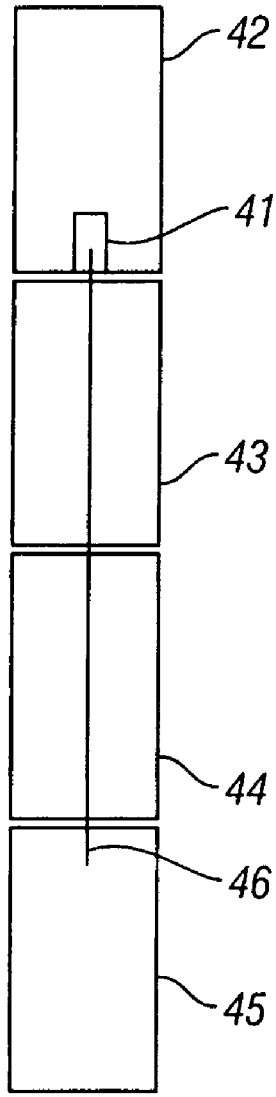
FIG. 7 is a schematic diagram of another logging system configuration utilizing a memory module in accord with the invention.

FIG. 7 shows a system of the invention in which the memory module 41 is positioned at the top portion of the BHA containing the drilling and logging tools. According to this embodiment, the memory module 41 is located in the upper portion of the tool 42. The memory module may be linked to several logging tools 43, 44, 45 contained in the BHA to transmit or record data. A central bus 46 is used to connect each tool to the memory module. The memory modules of the invention may also be combined with a permanent memory device to record the data (not shown). In such an embodiment the permanent memory may serve as a backup memory in the event the memory module is damaged or communication on the central bus is impaired. The central bus 46 may also be used for data transfer with the memory module 41 or permanent memory device by connecting to the bus from the end of the tool 42.

The invention provides substantial benefits over conventional data transfer techniques. The invention provides an instant dump of recorded information. All the tools in the BHA can send their real-time or recorded-mode data to a small memory sub, which when retrieved at the surface, can be quickly removed and replaced with a blank memory sub. Field personnel can then bring the full memory to the data processing unit and downloaded the recorded data over a 100 Mbps link, for example. The invention also permits more flexible and faster operations. All tools can be programmed and data from the tools downloaded at very high speeds from one point.

For the purposes of this specification it will be clearly understood that the word "comprising" means "including but not limited to", and that the word "comprises" has a corresponding meaning.

While the invention has been described with respect to a limited number of embodiments, those skilled in the art will appreciate that other embodiments can be devised which do not depart from the scope of the invention. For example, the memory modules of the invention may be implemented in various configurations with different dimensions and additional features such as a fishing head for remote retrieval. Accordingly, the scope of the invention should be limited only by the attached claims.

What is claimed is:

1. A system for transferring data to or from a logging tool for drilling operations within a subsurface formation, comprising:

a logging tool for making measurements of subsurface properties while drilling through the subsurface formation the tool including at least one sensor and at least one processor for receiving and formatting signals from the at least one sensor, the at least one sensor and the at least one processor disposed within a main tool body;

a memory module housed within the tool to record and store data including data related to the measurements;

the memory module being extractable from the main tool body while the tool is at the surface during the course of said drilling operations; and the memory module configured to couple to a data processor to receive the stored data and/or transfer data to the memory module.

2. The system as described in claim 1, wherein the memory module is cylindrical in form and adapted to couple with electronic circuitry within the tool.

3. The system as described in claim 1, wherein the memory module includes non-volatile memory means.

4. The system as described in claim 1, wherein the tool and memory module include inductive couplers to couple the module with the electronic circuitry within the tool.

5. The system as described in claim 1, wherein the tool and memory module include electrical connectors to couple the module with the electronic circuitry within the tool.

6. The system as described in claim 3, wherein the memory module is adapted to store drilling parameter information for use by the tool during the drilling operation.

7. The system as described in claim 1, wherein the memory module is inserted into an end portion of the tool.

8. The system as described in claim 1, wherein the memory module is inserted into and housed in an aperture on a side of the tool.

9. The system as described in claim 1, further comprising a data processing interface to connect and establish communication between the data processor and the memory module.

10. The system as described in claim 9, wherein the data processor forms part of a surface computer system.

11. The system as described in claim 1, further comprising a second memory module for insertion within the tool to replace an extracted module, the second module to record and store data.

12. A method for transferring data to or from a logging tool adapted for drilling operations within a subsurface formation, comprising:

housing a memory module to record and store data within a tool for making measurements of subsurface properties while drilling through the subsurface formation;

measuring a subsurface property using at least one sensor and at least one processor disposed within a main tool body forming part of the logging tool;

recording and storing data related to the measurements in the memory module;

retrieving the memory module by extracting the module from the main tool body while the tool is at the surface during the course of said drilling operations; and downloading the stored data contained in the memory module to data processing equipment.

13. The method as described in claim 12, further comprising:

replacing the retrieved memory module in the logging tool with a second memory module; and continuing to record and store data during a drilling operation.

14. The method as described in claim 12, further comprising:

loading the memory module with selected data; and inserting the memory module into the logging tool prior to a drilling operation.

15. A memory module for a logging tool for drilling operations within a subsurface formation, comprising:

a modular memory body having an inner end and an outer end;

the modular memory body to record and store data obtained with a tool for making measurements of subsurface properties while drilling through the subsurface formation;

non-volatile memory means housed within the modular memory body; and coupling means at the inner end of the modular memory body to establish communication between the modular memory and electronic circuitry inside the tool;

wherein the memory body is extractable from the tool while the tool is at the surface during the course of said drilling operations.

16. The memory module as described in claim 15, further comprising O-rings disposed on the outer surface of the memory module body to provide a seal between the memory module body and the tool.

17. The memory module as described in claim 15, wherein the memory module body allows for expansion of the modular body.

18. The memory module as described in claim 15, wherein the memory module body includes a threaded section at the outer end of said module body to provide for the extraction of the modular memory body from the tool.

19. The memory module as described in claim 15, wherein the memory means comprises a Flash or EPROM device.

20. The memory module as described in claim 15, wherein the memory means comprises a chip on board design with chips mounted on a printed circuit board.

21. The memory module as described in claim 15, wherein the coupling means at the inner end of the modular memory body consists of an inductive coupler.

22. The memory module as described in claim 15, wherein the coupling means at the inner end of the modular memory body consists of an electrical connector.

* * * * *